US008468719B2

(12) United States Patent
Dvorak

(10) Patent No.: US 8,468,719 B2
(45) Date of Patent: Jun. 25, 2013

(54) TRANSPARENT OUTSOLE WITH VISIBLE ARTWORK

(75) Inventor: Michael James Dvorak, Superior, CO (US)

(73) Assignee: Karman, Inc., Aurora, CO (US)

( * ) Notice: Subject to any disclaimer, the term of this patent is extended or adjusted under 35 U.S.C. 154(b) by 335 days.

(21) Appl. No.: 12/800,319

(22) Filed: May 13, 2010

(65) Prior Publication Data

US 2011/0277251 A1 Nov. 17, 2011

(51) Int. Cl.
*A43B 13/00* (2006.01)

(52) U.S. Cl.
USPC ..... 36/25 R; 36/17 R; 36/136

(58) Field of Classification Search
USPC ..... 36/17 R, 25 R, 136
See application file for complete search history.

(56) References Cited

U.S. PATENT DOCUMENTS

| | | | | | |
|---|---|---|---|---|---|
| 2,480,689 | A * | 8/1949 | Allen | 36/17 R |
| 2,755,567 | A * | 7/1956 | Rudine | 36/11.5 |
| 3,082,556 | A * | 3/1963 | Schwartz et al. | 40/636 |
| 3,921,313 | A * | 11/1975 | Mahide et al. | 36/4 |
| 4,347,673 | A * | 9/1982 | Svetlik | 36/32 R |
| 4,712,314 | A * | 12/1987 | Sigoloff | 36/112 |
| 5,084,988 | A | 2/1992 | Berger | |
| 5,659,979 | A | 8/1997 | Sileo | |
| 5,822,885 | A * | 10/1998 | Loverin | 36/25 R |
| D430,966 | S | 9/2000 | Brady et al. | |
| 6,226,895 | B1 * | 5/2001 | McClelland | 36/17 R |
| 6,539,646 | B2 * | 4/2003 | Brooks et al. | 36/30 R |
| 6,601,319 | B1 * | 8/2003 | Clements | 36/17 R |
| 7,003,900 | B2 * | 2/2006 | Trommer | 36/1 |
| 7,213,354 | B1 * | 5/2007 | Byrd et al. | 36/136 |
| 7,225,491 | B2 * | 6/2007 | Reed et al. | 12/142 P |
| 7,421,806 | B2 | 9/2008 | Braynock et al. | |
| 7,836,609 | B2 * | 11/2010 | Covatch | 36/17 R |
| 8,024,872 | B2 * | 9/2011 | Pettis | 36/73 |
| 2004/0261294 | A1 * | 12/2004 | Kawata | 36/44 |
| 2005/0274043 | A1 * | 12/2005 | DeSaix | 36/59 R |
| 2009/0071035 | A1 * | 3/2009 | La Rochelle | 36/14 |

OTHER PUBLICATIONS

Unknown Auther, "Nike Air Force 09 Low—Basketball Sneaker" Sneakernews.com, Mar. 21, 2009, <http://www.kicksaholic.com/nike-air-force-l-supreme-futura-matte-silver/nike-air-force>; <http://sneakernews.com/2009/03/21/nike-air-force-09-low-three-new-colors/>.

Anerson Bean Boots, "Our Story", 2011, <andersonbean.com>; <http://andersonbeanboots.com/cowboyboots/?page_id=2>.

* cited by examiner

*Primary Examiner* — Marie Patterson
(74) *Attorney, Agent, or Firm* — K Kalan; Berenbaum Weinshienk, PC

(57) ABSTRACT

An article of footwear comprising an upper portion, an outsole portion disposed opposite the upper portion, and a midsole portion disposed intermediate the upper portion and the outsole portion, the midsole portion connected to the upper portion; and a sole artwork portion disposed intermediate the midsole portion and the outsole portion and connected to the midsole portion, the outsole portion configured and dimensioned to allow the sole artwork portion to be visible through a portion of the outsole portion, and a method for making the same.

25 Claims, 2 Drawing Sheets

TRANSPARENT OUTSOLE WITH VISIBLE ARTWORK

BACKGROUND

The developments described herein relate to an article of footwear with artwork visible through the sole of the footwear, and a method by which artwork may be displayed through the sole of the footwear.

The process of boot or shoe manufacturing utilizing a Goodyear welt has existed since at least 1871. It is a manner in which boots have been constructed since that time.

Generally speaking, in the Goodyear welting process, the upper part of a shoe is shaped over a last and fastened to the inner and upper sole by sewing a welt (i.e. a leather strip or other suitable material). As well as using a welt, a thread 12 strands thick may be used. The sole is then attached to the welt of the shoe with a high strength adhesive.

Heretofore, visible soles or artwork on the bottom side of products have been seen on skateboards, snowboards and in various examples, skate shoes. For example, a transparent medium can be used to display a variety of images on the side of the shoe or on an interchangeable tongue on a lace-up shoe. A clear sole may be used to provide an internal view of the fit of the shoe, as opposed to a means to display art. A clear sole may also be used to display various artwork in the context of a cemented outsole, but not in a boot or shoe utilizing the Goodyear welt process.

A multi layer sole, using a translucent exterior layer, is also known, however, it also uses cemented construction and shows underlying colors and patterns, rather than artwork. Furthermore, the design features cemented construction, rather than Goodyear welted construction. Other types of footwear may have a transparent bottom over a basic sole pattern. The use of a rubber outsole to provide durability is known in the art for example, boots which uses welted construction and a black rubber outsole to increase durability.

Thus, it may be desirable to have a sturdy, durable item of footwear, made by a process that results in a well-made shoe or boot, that incorporates an individualized graphic or piece of artwork that can be incorporated into and displayed on the bottom or sole of the footwear.

SUMMARY

These developments may graphically present an image on the sole of a well-made boot or shoe, as well as allow for a system, method and process of manufacturing a boot or shoe with a durable design and with a graphic image on the sole of the boot or shoe. In the claimed process, many of the typical processes of boot manufacturing can remain intact and utilize a time-honored boot making tradition, yet utilize current state-of-the-art materials, such as the a transparent sole with integrally incorporated graphics. The development allows for a boot that displays art on the sole, yet is functional and durable for everyday use.

The development also provides quality and craftsmanship, works within the current requirements for performance and durability that has come to be expected from a Goodyear welted boot, and allows the user to "show" their soles (and whatever art they may choose) as they use their boots.

DETAILED DESCRIPTION OF THE DRAWINGS

The developments hereof relate to an article of footwear configured to display an item of artwork or graphic elements visible on the sole of the footwear. In various implementations, the footwear has at least an upper portion, a midsole portion, an article of artwork which may include a graphic design, and an outsole portion. The artwork or graphic elements may be integrated with the footwear so as to be visible from the bottom of the footwear. The artwork may be visible through the sole of the footwear or on the heel of the footwear or both. In some implementations, the artwork or graphic elements may take a variety of styles, shapes and sizes to suit an individual's taste while being of a size and shape suitable for display through the sole of the footwear.

Figure 1:
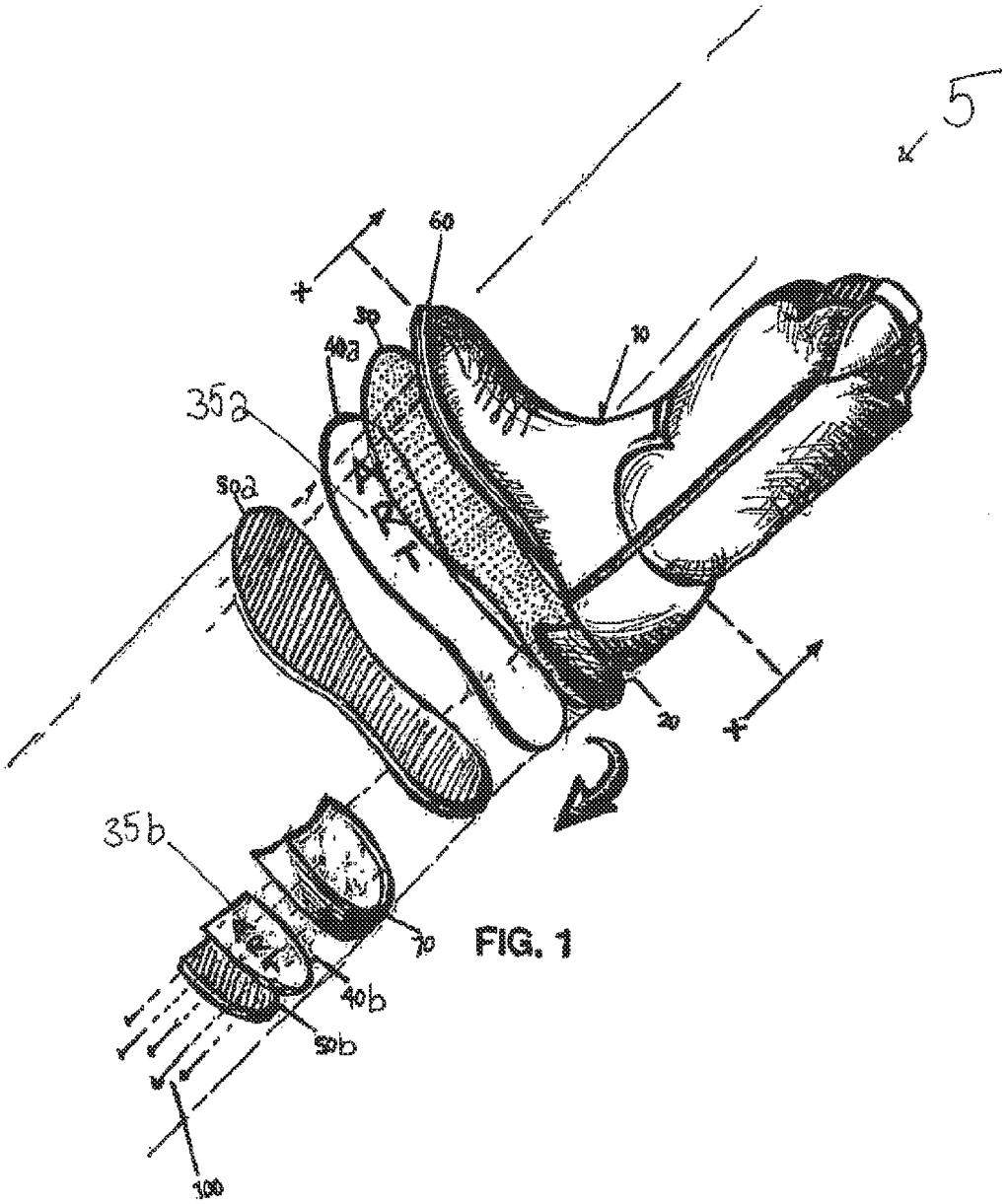
FIG. 1—Shows an exploded isometric view of the footwear

As generally shown in FIG. 1, an implementation of an article of footwear 5 is shown. The article of footwear 5 illustrated in FIG. 1 is a boot, in an exploded view, with vamp or upper portion 10 and a Goodyear welt 60. However, footwear 5 is not limited to boots. The footwear 5 is shown prior to assembling the component parts of the footwear. The component parts include a vamp or upper portion 10 and a heel counter or spur ridge 20. The heel counter or spur ridge 20 may be made of any suitable material such as plastic, leather, or other materials known to those of ordinary skill in the footwear arts.

The midsole 30 is shown in position relative to the heel counter or spur ridge 20 and relative to the vamp or upper portion 10. The midsole 30 may be made of any suitable material known to those of ordinary skill in the art, such as rubber or textured rubber.

Also shown in FIG. 1 is the artwork portion 40, shown as first artwork portion 40*a* and second artwork portion 40*b*. The artwork may be a decal, or artwork integrally molded into an outsole. The artwork may change between heel and vamp, thus different artwork may be displayed on the sole artwork portion 40*a* and on the heel artwork portion 40*b*, as shown by sole art 35*a* and heel art 35*b*.

The outsole 50 is shown as outsole portion 50*a* and heel outsole 50*b*, in their respective positions relative to the artwork portion 40. The outsole 50 may be made from a clear or translucent material, such as polyurethane or other suitable materials known to those skilled in the art.

The Goodyear welt 60 is shown as ultimately holding together the various components 10, 30, 40*a* and 50*a* of the footwear 5. The Goodyear welt 60 may be a plain stitch through at least the outsole, mid-sole and welt.

The heel 70 is shown in position relative to the other components at the heel end of the footwear. The heel 70 may be made of rubber, composite leather or leather, or any other suitable materials. The heel nails 100 ultimately affix the heel to the footwear 5.

The upper portion 10 of the boot or shoe 5 may be constructed in the typical manner, using traditional materials and processes. The mid-sole 30 (of rubber or other material) may be fixedly attached to the vamp or upper portion 10 of the boot or shoe 5 as a substrate for a decal or other material bearing a graphic.

Artwork 40 as shown in FIG. 1 may be a decal, vinyl sticker or integrally molded graphic The wording ART in FIG. 1 is not intended to refer to prior art, but rather, to the artwork 40. Any selection of various materials or processes, including vinyl decal, screen print, integrally molded artwork or any other available substrates may be placed between the midsole 30 and the outsole 50, or may be integrally molded into the outsole 50.

Figure 2:
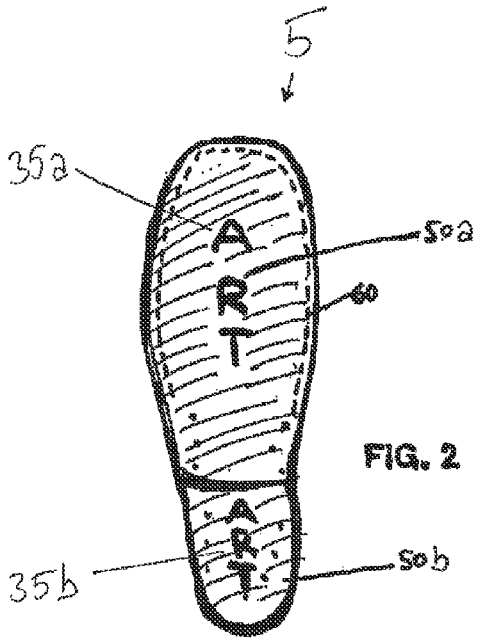
FIG. 2—Shows a bottom elevational view of the sole of the footwear

As shown in FIG. 2, the Goodyear welt 60 is visible around the applicable portion of the footwear 5. The outsole 50, shown as outsole portion 50*a* and heel outsole 50*b*, are seen from a bottom elevational view. The sole art 35*a* and heel art 35*b* are shown by the wording ART. Applicant wishes to clarify that this wording is not intended to refer to prior art, but rather, to artwork 40.

The heel 70 may be of any typical constructions—for example, Leather, Robus, Synthetic, rubber, or other typical constructions or materials known to those of skill in the art. In any case, the heel 70 serves as the substrate for the application of a decal or other artwork on the second outsole portion 40*b*, or a point of adhesion for an integrally molded heel.

Figure 3:
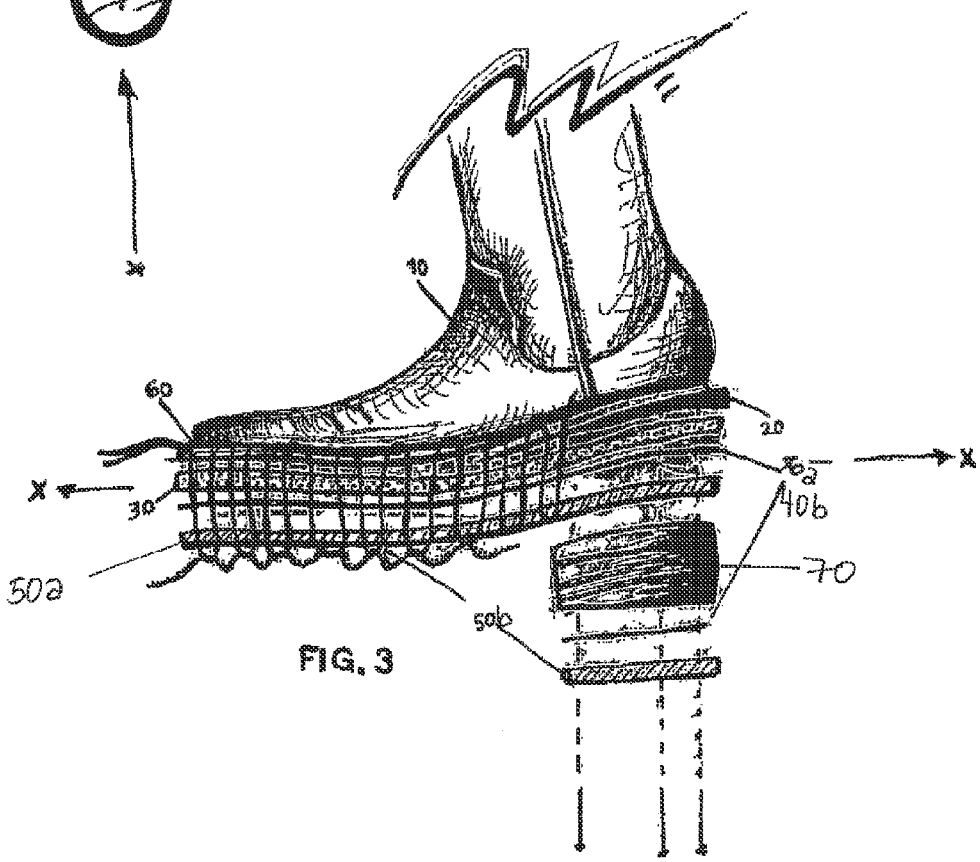
FIG. 3—Shows an exploded side elevational view of the footwear

As shown in FIG. 3, the welt 60 is in the traditional manner, and passes through the upper portion 10
the midsole 30
the sole artwork 40*a*, and
the outsole portion 50*a*.

Additional processes for assembling the heel portion of the footwear 5, shown in FIG. 3, include assembling— heel 70,
heel artwork 40*b*, bearing the same style of decal or integrally molded artwork
heel outsole 50*b*, and
nails 100.

Although the above description contains many specificities, these should not be construed as limiting the scope of the development rather providing illustrations of some embodiments of this development.

I claim:

1. An article of footwear comprising:
a. an upper portion;
b. an outsole portion disposed opposite the upper portion,
c. a midsole portion disposed intermediate the upper portion and the outsole portion, the midsole portion connected by stitching to a welt to the upper portion;
d. a sole artwork portion disposed intermediate the midsole portion and the outsole portion and connected to the midsole portion, the outsole portion configured and dimensioned to allow the sole artwork portion to be visible through a portion of the outsole portion;
e. the welt adapted and configured to ultimately connect the upper portion, outsole portion, and midsole portion; and
f. the upper portion, midsole portion and outsole portion adhered with non-molded construction.

2. The article of footwear of claim 1, further comprising:
a. a heel portion connected to the outsole portion at a heel end of the footwear;
b. a heel outsole disposed opposite the heel portion and connected to the heel portion; and
c. a heel artwork portion disposed intermediate the heel portion and the heel outsole, the heel outsole configured and dimensioned to allow the heel artwork to be visible through a portion of the heel outsole.

3. The article of footwear of claim 1, wherein the midsole portion comprises at least one of rubber or leather.

4. The article of footwear of claim 2, wherein the heel portion comprises at least one of rubber, composite leather, or leather.

5. The article of footwear of claim 1, wherein the outsole portion is substantially transparent.

6. The article of footwear of claim 2, wherein the heel outsole is substantially transparent.

7. The article of footwear of claim 1, wherein the outsole portion comprises polyurethane.

8. The article of footwear of claim 2, wherein the heel outsole comprises polyurethane.

9. The article of footwear of claim 1, further comprising;
(a) a first portion, comprising the midsole portion and upper portion connected by the welt; and
(b) a second portion, comprising the outsole portion, the second portion connected to the first portion by the welt.

10. The article of footwear of claim 1, wherein the welt comprises a welt made by the Goodyear welting process.

11. The article of footwear of claim 2, wherein the heel portion, heel outsole, and heel artwork portion are connected to the heel end of the footwear by a nail.

12. The article of footwear of claim 1, wherein the sole artwork comprises at least one of a decal, a vinyl sticker, an integrally molded graphic, or a screen print.

13. The article of footwear of claim 2, wherein the heel artwork comprises at least one of a decal, a vinyl sticker, an integrally molded graphic, or a screen print.

14. The article of footwear of claim 1, wherein the sole artwork is one or more of transferred onto, integrally molded into, and screen printed onto the outsole.

15. The article of footwear of claim 2, wherein the heel artwork is one or more of transferred onto, integrally molded into, and screen printed onto the heel outsole.

16. A method of footwear construction, comprising:
a. constructing a welted portion of an article of footwear by connecting an upper portion, a midsole portion, and an outsole portion using stitching through a welt; the outsole portion configured and dimensioned to allow an artwork portion disposed between the midsole portion and the outsole portion to be visible through the outsole portion; the welted portion of the article of footwear adhered with non-molded construction;
b. constructing a footwear heel by connecting a heel portion, a heel artwork, and a heel outsole configured and dimensioned to allow the heel artwork to be visible through the heel outsole; and
c. connecting the footwear heel to the welted portion at a heel end of the footwear.

17. The method of claim 16, wherein the outsole portion and the heel outsole are substantially transparent.

18. The method of claim 16, wherein the outsole portion and the heel outsole comprise polyurethane.

19. The method of claim 16, further comprising constructing the welted portion using the Goodyear welting process.

20. The method of claim 16, further comprising nailing the heel portion, heel outsole, and heel artwork to the heel end of the footwear.

21. The method of claim 16, wherein the midsole portion comprises at least one of rubber or leather.

22. The method of claim 16, wherein the heel portion comprises at least one of rubber, composite leather, or leather.

23. An article of footwear comprising:
a. an upper portion;
b. an outsole portion disposed opposite the upper portion,
c. a midsole portion disposed intermediate the upper portion and the outsole portion, the midsole portion connected by stitching to a welt to the upper portion;
d. a sole artwork portion integral with the outsole portion, the outsole portion configured and dimensioned to allow the sole artwork portion to be visible through a portion of the outsole portion, e. the welt adapted and configured to ultimately connect the upper portion, outsole portion, and midsole portion; and f. the upper portion, midsole portion and outsole portion adhered with non-molded construction.

24. The article of footwear of claim 23, further comprising:

a. a heel portion connected to the outsole portion at a heel end of the footwear;

b. a heel outsole disposed opposite the heel portion and connected to the heel portion; and c. a heel artwork portion integral with the heel outsole, the heel outsole configured and dimensioned to allow the heel artwork to be visible through a portion of the heel outsole.

25. A boot comprising:

a. a first sole portion, comprising i. an upper portion; and ii. a midsole portion connected to the upper portion by stitching to a welt configured to connect the upper portion, outsole portion, and midsole portion;

b. an outsole portion connected to the first sole portion by a welt;

c. artwork disposed intermediate the midsole portion and the outsole portion, the outsole portion further configured to allow the artwork to be visible through a predetermined portion of the outsole portion; and d. the upper portion, midsole portion and outsole portion adhered with non-molded construction.

* * * * *

US008468719C1

(12) EX PARTE REEXAMINATION CERTIFICATE (10420th)

United States Patent

Dvorak

(10) Number: US 8,468,719 C1

(45) Certificate Issued: Nov. 26, 2014

(54) TRANSPARENT OUTSOLE WITH VISIBLE ARTWORK

(75) Inventor: Michael James Dvorak, Superior, CO (US)

(73) Assignee: Karman, Inc., Aurora, CO (US)

Reexamination Request:
No. 90/013,070, Dec. 2, 2013

Reexamination Certificate for:

| | |
|---|---|
| Patent No.: | **8,468,719** |
| Issued: | **Jun. 25, 2013** |
| Appl. No.: | **12/800,319** |
| Filed: | **May 13, 2010** |

(51) Int. Cl.
*A43B 13/00* (2006.01)

(52) U.S. Cl.
USPC ..... 36/25 R; 36/136; 36/17 R

(58) Field of Classification Search
None
See application file for complete search history.

(56) References Cited

To view the complete listing of prior art documents cited during the proceeding for Reexamination Control Number 90/013,070, please refer to the USPTO's public Patent Application Information Retrieval (PAIR) system under the Display References tab.

*Primary Examiner* — Patricia Engle

(57) ABSTRACT

An article of footwear comprising an upper portion, an outsole portion disposed opposite the upper portion, and a midsole portion disposed intermediate the upper portion and the outsole portion, the midsole portion connected to the upper portion; and a sole artwork portion disposed intermediate the midsole portion and the outsole portion and connected to the midsole portion, the outsole portion configured and dimensioned to allow the sole artwork portion to be visible through a portion of the outsole portion, and a method for making the same.

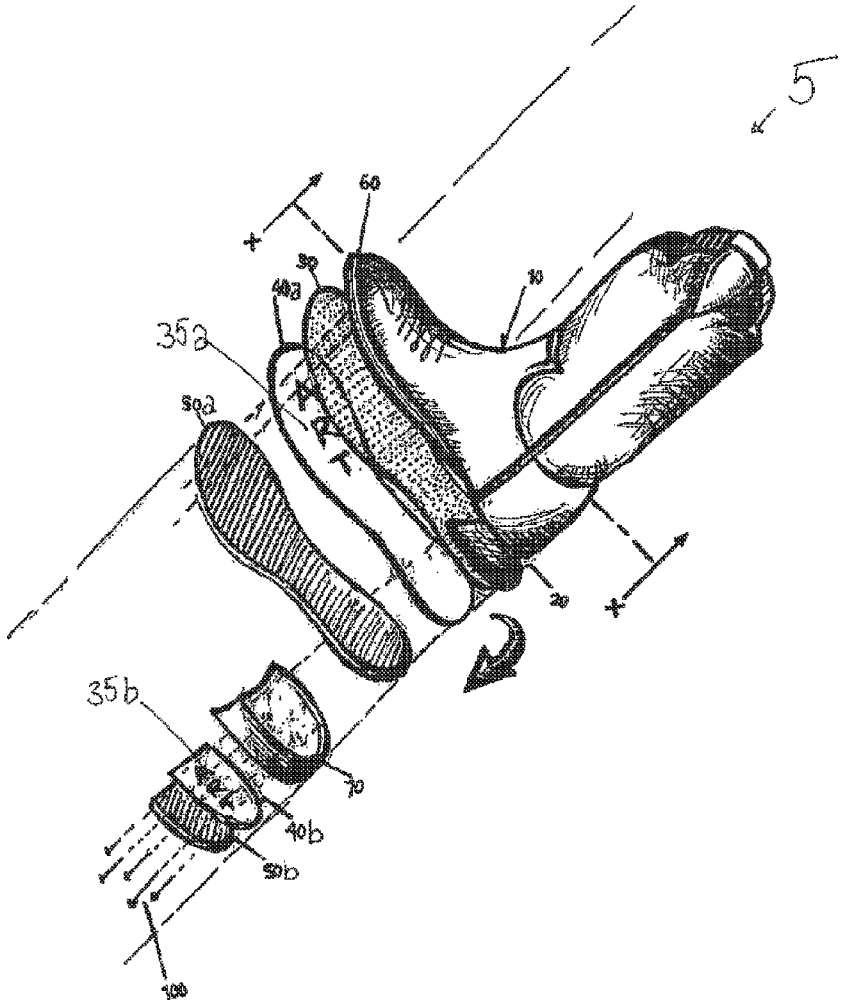

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-25 are cancelled.

* * * * *